United States Patent [19]

Palazzo

[11] Patent Number: 4,655,367

[45] Date of Patent: Apr. 7, 1987

[54] DOUBLE WALL STORAGE TANK FOR LIQUIDS

[76] Inventor: David T. Palazzo, P.O. Box 290676, Tampa, Fla. 33687

[21] Appl. No.: 884,389

[22] Filed: Jul. 11, 1986

Related U.S. Application Data

[63] Continuation-in-part of Ser. No. 775,140, Sep. 12, 1985, and a continuation-in-part of Ser. No. 818,258, Jan. 13, 1986.

[51] Int. Cl.[4] ..... B65D 87/24

[52] U.S. Cl. ..... 220/445; 220/420

[58] Field of Search ..... 220/445, 448, 466, 469, 220/420, 1 B, 855, 465

[56] References Cited

U.S. PATENT DOCUMENTS

| | | | |
|---|---|---|---|
| 1,927,255 | 9/1933 | Brown | 220/420 |
| 2,268,517 | 12/1941 | Small | 220/445 |
| 2,767,962 | 10/1956 | Blackburn | 220/420 |
| 2,907,177 | 10/1959 | Daley et al. | 220/420 |
| 4,537,328 | 8/1985 | Keesee et al. | 220/445 |

*Primary Examiner*—George T. Hall

*Attorney, Agent, or Firm*—Pettis & McDonald

[57] ABSTRACT

A method is disclosed for manufacturing from a rigid single wall tank a rigid double wall tank for storage of liquids. The method includes the steps of applying to at least a portion of the outer surface of the inner tank a flexible sheetlike spacing material having a substantially continuous and generally planar surface with a plurality of projections extending outwardly of the planar surface and engaging the outer surface of the inner tank and then applying over the inner tank outer surface and the spacing material a sheath of a rigid and liquid-tight material. From this method there results a rigid double wall storage tank having an outer sheath spaced from the outer surface of the inner tank.

6 Claims, 9 Drawing Figures

DOUBLE WALL STORAGE TANK FOR LIQUIDS

RELATED APPLICATION

This application is a continuation-in-part of application Ser. No. 775,140 filed Sept. 12, 1985, and of application Ser. No. 818,258 filed Jan. 13, 1986, both entitled Double Wall Storage Tank for Liquids and Method of Making Same and filed in the name of of David T. Palazzo.

FIELD OF THE INVENTION

This invention relates to tanks for the storage of liquids, and more particularly to double wall tanks for underground storage of liquids.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has prompted the search for methods of fabricating relatively inexpensive double wall tanks. This burden has also given impetus to the search for a method of remanufacturing existing single wall tanks into a double wall assembly with means for detecting the presence of any leaks into the space between the two walls.

SUMMARY OF THE INVENTION

In view of the foregoing, it is the object of the present invention to provide an economical method of manufacturing a double wall storage tank from rigid single wall tank. It is a further object of the invention to provide such a method in which at least a portion of the outer wall or sheath of the tank is spaced from the inner tank. It is an additional object of this invention to provide a double wall storage tank in which at least a portion of the outer wall or sheath of the tank is spaced from the inner tank.

To achieve these and other objects that will become readily apparent to those skilled in the art, this invention provides a method of manufacturing from a rigid, single wall inner tank a rigid double wall tank for the storage of liquids. The method includes the steps of applying to at least a portion of the outer surface of the inner tank a spacing material comprising a flexible sheetlike material having a continuous and generally planar surface with a plurality of projections extending outwardly of the planar surface on at least one side of the material, the material being applied to the inner tank with projections engaging the inner tank outer surface, and then applying over such inner tank outer surface and the spacing material a sheath of a material that is substantially rigid and liquid tight. The projections on the spacing material serve to space the planar surface of the spacing material from the outer surface of the inner tank to provide for substantially free passage of liquids between the inner tank outer surface and the spacing material planar surface.

BRIEF DESCRIPTION OF THE DRAWINGS

Particularly preferred embodiments of the method and apparatus of this invention will be described in detail below in connection with the drawings in which.

DESCRIPTION OF PREFERRED EMBODIMENTS

Figure 1:
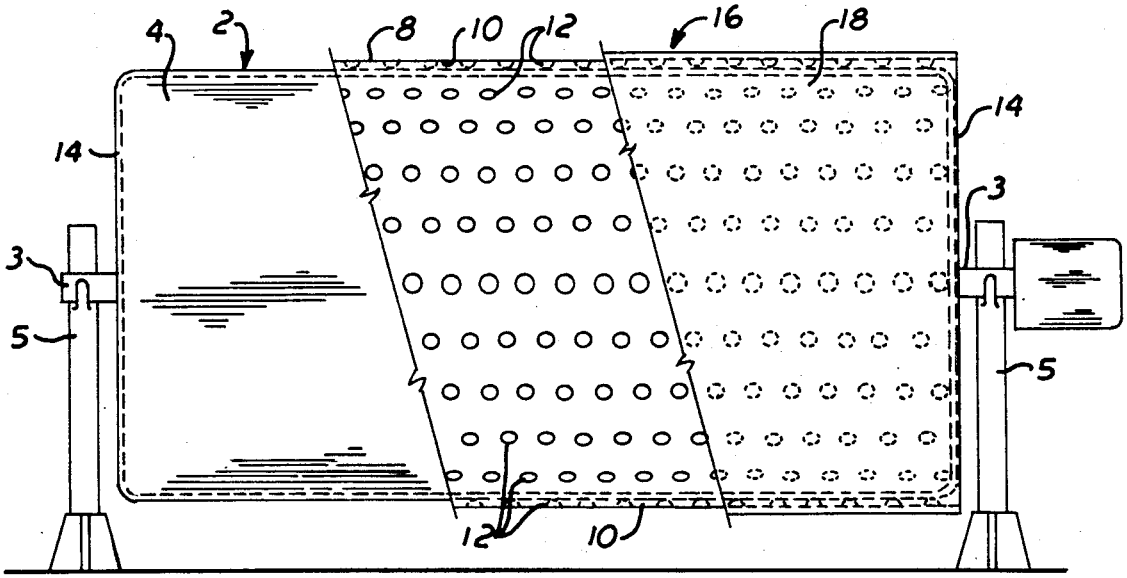
FIG. 1 is a side elevation, partially in section, of a tank being fabricated according to the present invention, illustrating various steps in the fabrication process.
Figure 2:
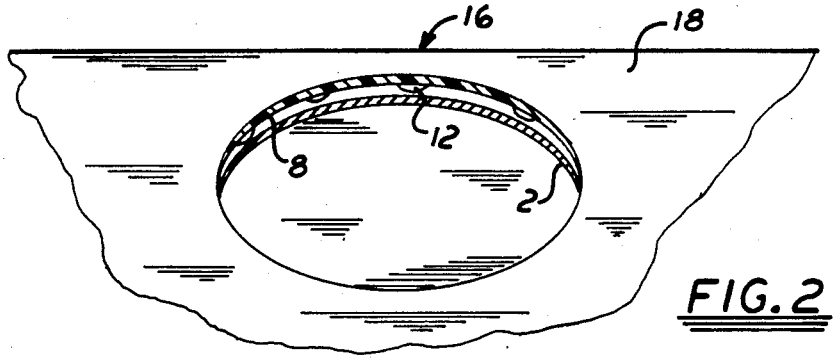
FIG. 2 is a fragmentary upper perspective view of the tank of FIG. 1 illustrating the cutting of an aperture through the tank wall and sheath.

One preferred embodiment of the apparatus of this invention is illustrated in FIGS. 1 through 5 and 7. FIG. 1 is a side elevational view illustrating the manner of making the completed tank assembly by the application to the inner storage tank of the various materials described below.

While various forms and shapes of tanks may be utilized in practicing this invention, the most common shape utilized for underground storage is that of cylinder, generally a right circular cylinder, having closed end portions. For simplicity of illustration this configuration of tank is utilized for illustrating the preferred embodiment of the invention. Also, while virtually any construction of a rigid inner tank, whether of metal or fiberglass or of other materials, may be utilized in practicing this invention, one preferred and readily available type of structure is a tank formed of welded steel, having an appropriate corrosion resisting coating on the liquid contacting surfaces. For purposes of illustration such a steel tank will be described. It also is to be understood that the tank to be used could be a newly fabricated tank, which may or may not have any manhole opening cut in it, or it may be a previously used tank removed from its prior underground installation and cleaned for reuse with this invention.

To prepare an uncoated or a previously used steel tank, it is desirable that the exterior surface be conventionally sandblasted and coated with a rust inhibitive paint. Then, to simplify subsequent steps, it is preferred but not required that a spindle 3 be attached, such as by welding, to the center of each tank head or end portion, collinear with the axis of the tank. As shown in FIG. 1, these spindles 3, and thus the inner tank 2, may then be supported off the ground on conventional uprights 5, shown in FIG. 1. This provides for rotation of the tank about its axis for purposes to be set forth below. Upon completion of the fabrication processes utilizing such rotation, there spindles 3 may be cut off or otherwise removed.

In the next step of the present invention, a spacing material is applied to at least a portion, preferably the lower portion, of the exterior surface of the inner tank 2 and desirably is applied to the entire cylindrical sidewall 4 of the tank 2. This spacing material 8, illustrated most clearly in FIGS. 1 and 7, comprises a flexible sheetlike material having a continuous and generally planar surface 10 with a plurality of projections 12 extending outwardly of the planar surface 10 on at least one side of the material 8. This spacing material 8 may be of any suitable composition having the desired planar surface with projections extending outwardly therefrom and preferably is rather stiff but sufficiently flexible to be wrapped around the inner tank 2. One suitable material is a sheet of synthetic resin such as Mylar that has been molded or vacuum formed to produce the projections 12. Such projections 12 may be either solidly formed with the planar portion of the sheet 8 or may be hollow, as may occur with vacuum forming of a sheet of such material 8. Even more preferable may be a spacing material formed of a suitable plastic material, resin and glass fiber matting formed over a flat mold. Such a mold would suitably have the configuration of a planar surface with a plurality of dimple-like recesses. A film of resin filling those recesses and forming a continuous coating over the planar portions of the mold is applied with a mat of fibrous material, suitably glass fibers, then being laid onto such mold and additional resin being applied over the mat. This provides a relatively thin but strong glass fiber reinforced spacing material upon its curing and removal from the mold. While the projections extending from the planar surface are illustrated as having the configuration of a portion of a sphere, numerous other configurations of the projections, including, without limitation, ridges and other geometrical shapes, should work satisfactorily as well.

The spacing material 8 preferably is wrapped continuously about the cylindrical sidewall portion 4 of the inner tank 2, as generally shown in FIG. 1. Depending upon the size of the inner tank 2 one or a plurality of sheets of such spacing material may be utilized. It is preferred to have the spacing material 8 extend over the outer surface of the cylindrical sidewall of the inner tank in a substantially continuous manner, with any joints in the material covered by an appropriate tape or other material.

In the preferred embodiment the spacing material 8 may be wrapped continuously about the cylindrical walls 4 of the inner tank 2 to form a cylindrical wrap with the axial extremities of that wrap adjacent or just short of the end portions 14 of the inner tank 2. In this wrapped condition the radially innermost portions of the projections 12 of the spacing material 8 will then engage the outer surface of the sidewalls 4 of the tank 2, thereby spacing the planar portions 10 of the inner surface of this spacing material away from the outer surface of the cylindrical sidewall 4 of that inner tank 2.

With the sheetlike spacing material 8 in place about the cylindrical sidewalls of the inner tank 2, the next steps in the fabrication of the exterior sheath of the tank may be taken. In this preferred embodiment the rigid sheath 16 preferably, and particularly the cylindrical sidewall portion 18 thereof, is formed by bonding resin impregnated glass fiber mats to the spacing material 8 in a conventional manner. It has been found convenient to fill any recesses on the outer surface of the spacing material 8 with resin to provide additional support for the projections 12 and then to lay sections of glass fiber matting over that spacing material 8 and apply suitable and well known additional resins to that matting. Alternatively, matting that is preimpregnated with resin could be used with equal facility. While the thickness of the sheath 16 may vary according to the severity of conditions anticipated, it should be of sufficient thickness to provide a substantially rigid sheath. It has been found that one-quarter inch of the cured, resin impregnated glass fiber matting generally provides sufficient strength and rigidity for the sheath 16.

To form the end portions 20 of the sheath 16, the resin impregnated glass fiber mat may be simply laid and wrapped around the tank end portions 14, forming a continuous structure with the cylindrical sidewall portion 18. Alternatively, and preferably, the end portions 20 of the sheath 16 may be fabricated separately from the cylindrical sidewall portion 18. Such a technique, illustrated in the fragmentary sectional view of FIG. 6, provides substantially the same end result as the continuous lay-up process shown in FIG. 5. However, this method of forming the end portions 20 separately may simplify the manufacture by permitting the formation of those end caps over a male mold plug, this permitting the glass fiber material to be laid substantially horizontally instead of vertically, as is required in a continuous layup approach of FIG. 5.

Figure 5:
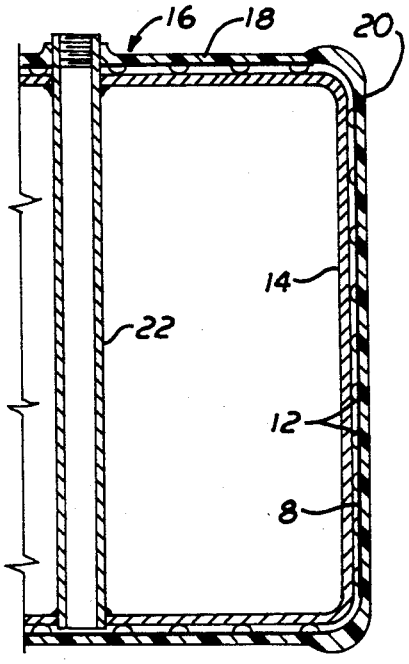
FIG. 5 is a partial side sectional view taken along line 5—5 of FIG. 4.
Figure 6:
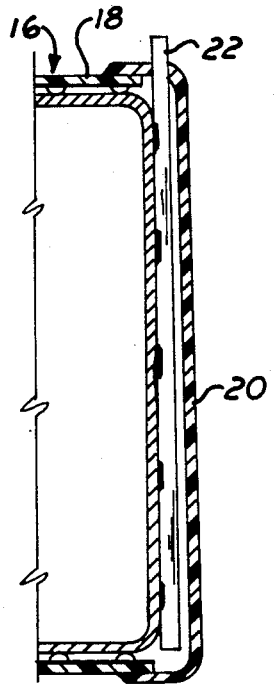
FIG. 6 is a side sectional view, similar to FIG. 5, but of a different embodiment of the end structure of the tank.
Figure 7:
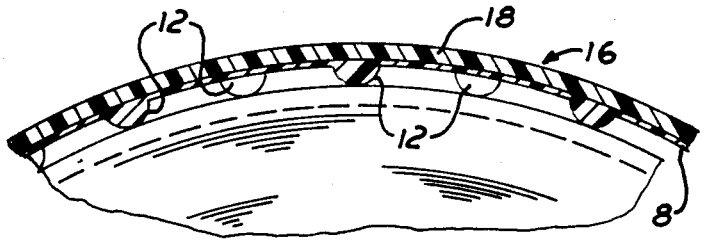
FIG. 7 is a cross-sectional view of the tank of FIG. 6.

As shown in FIG. 5, it is preferred, but not necessary, that the sheath end portions be formed with the sheath material overlying a section of the spacing material 8, with the projections 12 of that spacing material 8 engaging the outer surface of the respective end portions 14 of the inner tank. Also is shown in both FIGS. 5 and 6, the sheath end portions formed by either method are generally concave and dimensioned to extend over a respective inner tank end portion. The application of the resin either in the continuous layup process or in bonding preformed sheet end portions will serve to join those end portions in a sealing manner to the adjacent axial extremity of the sheath sidewall portion 18.

As shown in FIG. 6, a tube 22 may be bonded into one or both of the end portions 20, extending from a point adjacent the lowermost portion of the interior of sheath 16 through an aperture formed in the upper portions of sheath 16. In this embodiment the tube 22 extends between the inner surface of the end portion 20 of the sheath 16 and the exterior surface of the end wall of inner tank 2. The tube 22 could, alternatively, be located away from the end portions and extend between the respective cylindrical sidewall portions of the tank 2 and sheath 16. This tube 22 may conveniently be bonded into the sheath end portions 20 either during the lay-up of that end portion or subsequent thereto and preferably prior to the assembly of the end portion 20 onto the cylindrical sidewall portion 18 of the sheath 16. This tube 22 thus provides for insertion into the double wall tank of apparatus for use in detecting the presence of liquid in the space between the inner tank 2 and the sheath 16.

The remaining steps involved in the manufacture of the double wall tank of this invention may depend upon the nature of the inner tank 2 used in manufacturing the product. If the tank 2 is a previously used unit, or one that already incorporates a manhole or other aperture for access to the interior, such as element 24 shown in FIGS. 3 and 4, and may also include other plumbing connectors, the application of the sheath 16 is preferably done in a manner that bonds around those fittings and apertures, while providing for access to them. With this situation little additional work may be necessary to complete the manufacture of the product of this invention.

If the inner tank 2 from which this article is manufactured is a new tank, or a remanufactured one in which there exist no apertures or fittings, it is easiest to apply the sheath 16 around these cylindrical sidewalls in a continuous manner. Then to form the necessary opening into the interior of the tank, appropriate holes may then be cut by any suitable means, such as a hole saw or the like. In most tanks it is desirable to provide access to the interior that is large enough for entry of a person into the tank. This may be done by forming an aperture, as by cutting, through the sheath 16, the spacing material 8 and a portion of the cylindrical sidewall 4 of the inner tank 2, as shown in FIG. 5. Then, preferably from inside the tank, a hollow cylindrical member 24, preferably having a shape and size corresponding generally to the shape and size of the aperture cut, is sealingly joined to the cylindrical sidewall 4 of the tank 2, suitably by welding the joint adjacent the periphery of the aperture to the inner tank 2. This then provides the necessary manhole. Additional holes may be cut through the sheath 16 and inner tank 2 for insertion and attachment, suitably by welding, of additional fittings such as for introduction and withdrawal of liquid from the tank. When all of these fittings have been affixed to the tank, the portions of the sheath 16 adjacent those various fittings may then be bonded thereto with appropriate resin, to yield a finished structure as shown in the fragmentary perspective view of FIG. 3. A suitable coverplate 26 may be provided for the cylindrical member 24 as shown in FIG. 4. This coverplate 26 may conveniently be secured to the upper flange 28 of that cylindrical member 24 by conventional means, such as a plurality of bolts 30 extending through the coverplate 26 an the flange 28. In the coverplate 26 may be provided such items as a lifting ring 32 and conventional fittings 34 and 36 to provide for insertion of appropriate plumbing to facilitate introduction and withdrawal of liquids to be stored within the completed tank.

Figure 3:
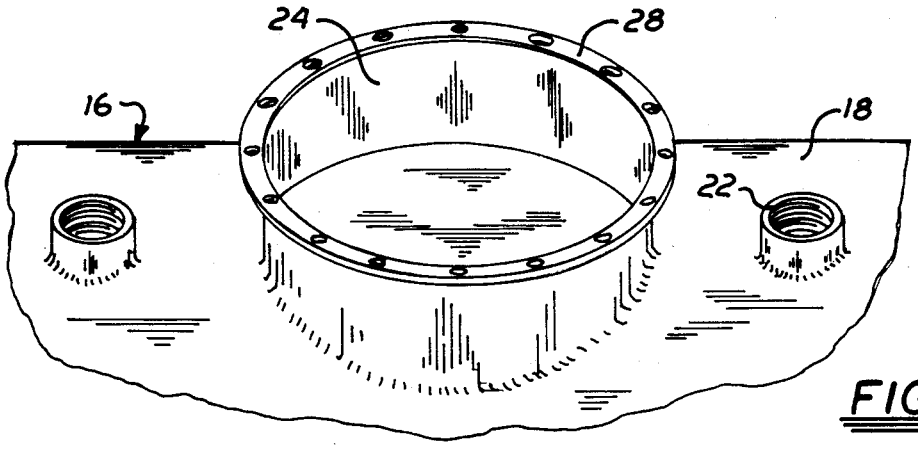
FIG. 3 is a perspective view of the apparatus of FIG. 2 illustrating the completed installation of a port and of plumbing connections.
Figure 4:
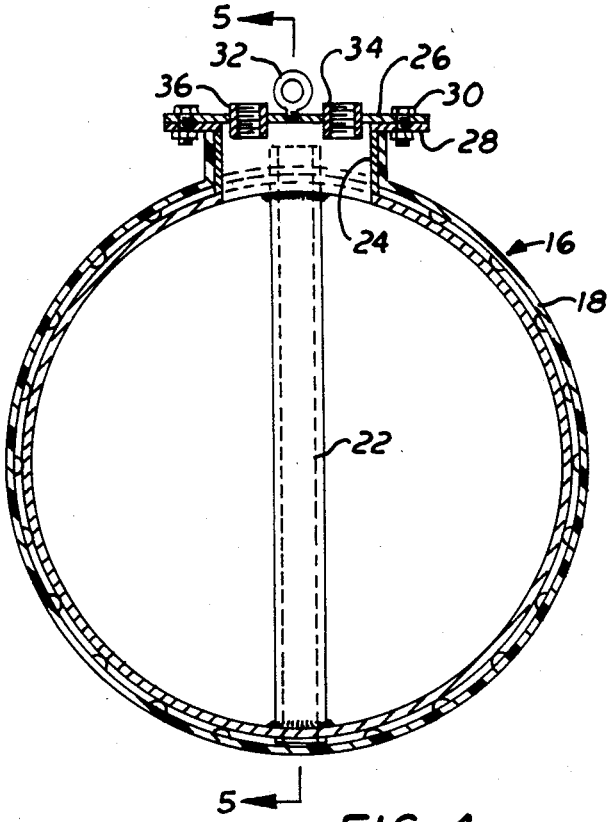
FIG. 4 is an end sectional view of a completed tank manufactured according to the process of FIG. 1.

An alternative positioning for the tube for use in detecting the presence of liquid in the space between the inner tank 2 and sheath 12 is illustrated in FIGS. 3, 4 and 5. In this embodiment, the tube 22, instead of extending within the space between the exterior of tank 2 and the inner surface of the sheath 16, as in FIG. 6, extends through the tank 2 itself. This tube 22 may be installed by providing a aperture through the cylindrical sidewall 18 of the sheath 16, through the adjacent upper portion of the inner tank 2 and then through the diametrically opposed lowermost portion of the inner tank 2. Thus, the tube 22 may be inserted through the sheath aperture and extend through the tank and through the aperture in the lowermost portion thereof, so that the lower portion of tube 22 is adjacent the lower portion of the space between the inner and 2 and sheath 16. The joints between the tube 22 and the outer sheath 16 of the inner tank 2 are sealed liquid-tight in conventional manners.

This structure shown in FIG. 4 provides substantially the same function for detecting the presence of liquid between the inner tank and sheath as does the structure of FIG. 5 and exchanges the somewhat more complicated installation for the benefit of additional rigidity in being attached, as by welding, to the inner tank 2 itself. In the structures of both FIG. 4 and FIG. 5 the tube 22 provides the means within the space between the inner tank exterior surface and the outer sheath inner surface for detecting the presence of liquids within that space and for withdrawing such liquid, if desired.

Figure 8:
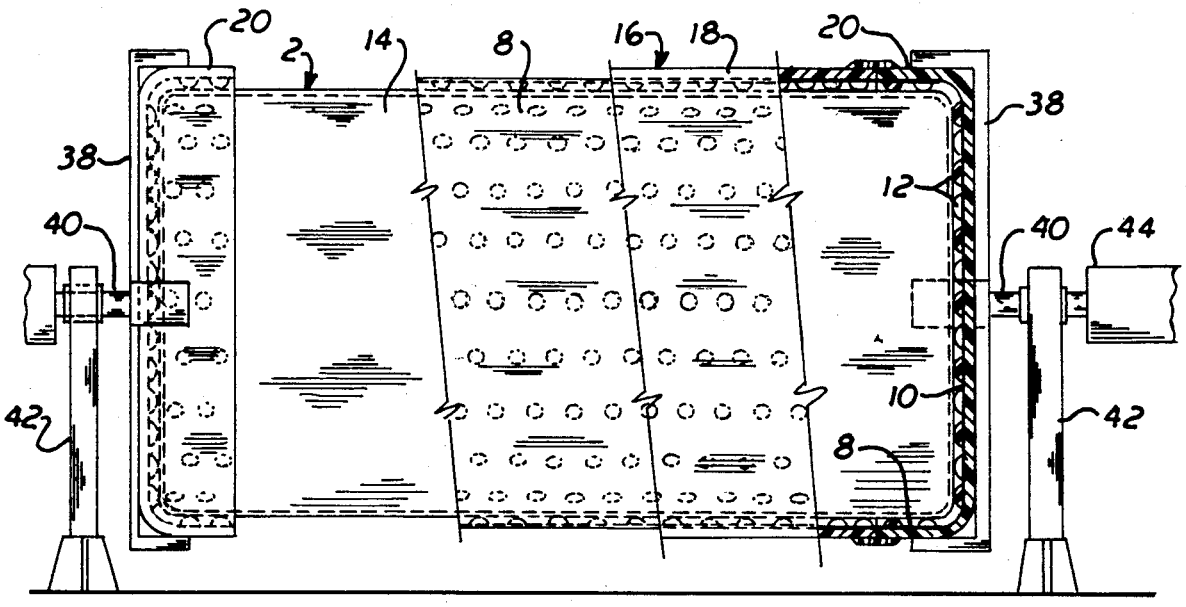
FIG. 8 is a side elevation partially in section, of additional embodiment of a tank being manufactured according to the present invention, illustrating various steps in the fabrication process of that embodiment.
Figure 9:
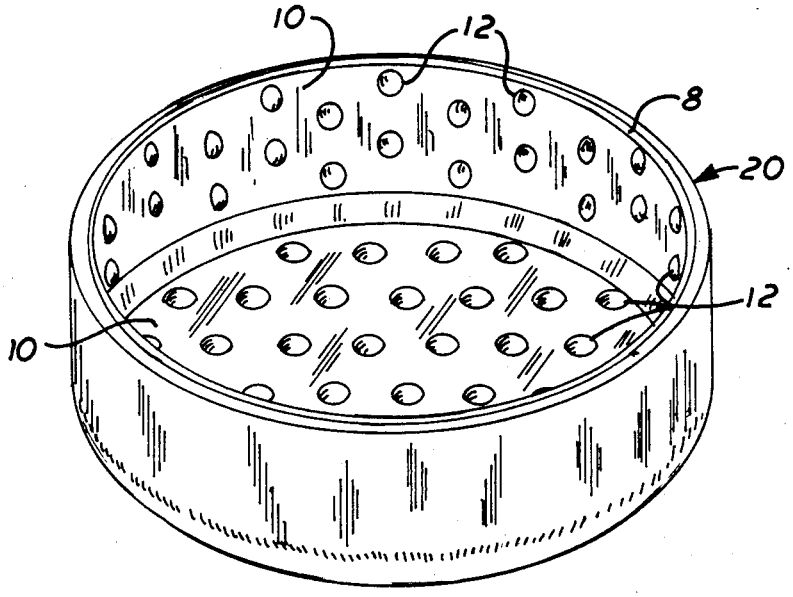
FIG. 9 is a perspective view of one of the sheath end portions utilized in the apparatus of FIG. 8.

An additional and slightly modified embodiment of the method of fabrication of the tank is illustrated in the drawings of FIGS. 8 and 9. In this embodiment a pair of concave sheath end portions, one of which is shown in FIG. 9, are fabricated, preferably of the same material forming the remainder of the sheath and preferably with the spacing material 8, described above, forming at least a substantial portion of the inner or concave surface of that end portion. Thus, in this preferred embodiment the inner or concave surface of the sheath end portion 20 is provided with a same projections 12 extending from that concave surface, with the planar portion 10 forming the bulk of the inwardly facing surface of that end portion. It is to be understood that, for the embodiment of FIG. 8, the end portion could be fabricated without this spacing material 8 with only slightly less utility.

These preformed end portions 20, suitably fabricated of the same resin impregnated glass fiber material as is used in the remainder of the sheath 16, are supportably engaged over the respective end portions 14 of the inner tank 2. Preferably, these sheath end portions 20 are dimensioned to provide a snug fit over the end portions 14 and axial extremities of the sidewall portion 4 of that inner tank 2, as shown in FIG. 8. These sheath end portions 20 are then engaged and supported by suitable rotatable supports as shown in FIG. 8. These rotatable supports may include brackets 38 attached to spindles 40 rotatably journalled in supports 42 for rotation by suitable drive means 44 about an axis generally coincident with the axis of inner tank 2.

With the end portions 20 of tank 2 thus so rotatably supported, the spacing material 8, described above, is then applied. The spacing material is applied to at least a portion and preferably to the entire remaining cylindrical sidewall portion 14 of the tank 2. After the spacing material 8 has been so applied, the sidewall portions 18 of the sheath 16 are then applied, again in the manner generally described with respect to the embodiment of FIG. 1. At the line of meeting between the sheath sidewall portions 18 and the two end portions 20 an additional strengthening layer of glass fiber tape and resin may suitably be provided to strengthen and further seal that joint. With the construction method of this embodiment the finished result will be substantially similar to that described with respect to the previous embodiment. Thus, the remaining steps of providing access apertures and liquid sensing tubes may be performed in substantially the same manner as with the previous embodiment.

Upon completion of the manufacturing steps set forth above both the inner tank 2 and its sheath 16 may have pressure applied to them, as by compressed air. With the apparatus illustrated in FIGS. 5 or 6 the application of pressure through the tube 22 will permit not only the testing of the sheath 16 for any leakage but also the testing of the tank 2 to ascertain if there is any leakage of that pressurized air from the space between the sheath 16 and the inner tank 2 into that inner tank.

By the foregoing construction there is thus provided a double wall tank that can be manufactured economically from a conventional steel single wall tank, and even from a used tank that has previously been removed from underground storage use. This structure provides an exterior sheath, which may be formed from a material that is free of any tendency to rust or corrode, and which is spaced from the inner tank to permit the collection within that space and thus the detection of any liquids leaking into that space, either from the tank or from sources exterior to the sheath. Thus may be determined the existence of any leakage of either the tank or the sheath by simply detecting the presence or nature of any liquid in that space. By the use of a relatively thick and rigid sheath, the strength of that sheath is enhanced over similar structures that may use flexible outer coverings. Furthermore, such a rigid external sheath permits testing of the integrity of the sheath and tank at substantial pressures, which could not be done with a flexible covering without danger of rupture. By the use of the sheetlike spacing material having a continuous and generally planar surface with a plurality of projections, the fabrication technique is far simpler than that of prior art structures that utilize elongated sections of split plastic tubing individually embedded in the surface of the inner tank to provide spacing.

While the foregoing describes in detail several preferred embodiments of the tank of this invention and its method of manufacture, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed is:

1. A double wall tank for the storage of liquids, comprising a substantially rigid inner tank having means for introducing thereinto and withdrawing therefrom liquids to be stored;

spacing material overlying a substantial portion of the outer surface of said inner tank, said spacing material comprising a flexible sheetlike material having a substantially continuous and generally planar surface with a plurality of projections extending outwardly of said planar surface on at least one side of said material, said material overlying said inner tank outer surface with said projections engaging said inner tank outer surface, whereby is provided for substantially free passage of liquids between said inner tank outer surface and the spacing material planar surface; and a substantially rigid sheath formed of a material that is substantially liquid tight, said sheath enclosing said inner tank and said spacing material and having at least a portion thereof spaced from said inner tank by said spacing material, whereby is formed a double wall tank having at least a portion of the rigid sheath thereof spaced from the inner tank.

2. A tank according to claim 1 wherein said spacing material overlies at least the lower portions of said inner tank when said tank is in its normal orientation, whereby any liquid introduced between the inner tank outer surface and the sheath inner surface will collect in the lower portions of the outer sheath inner surface.

3. A tank according to claim 2 further comprising means located within the space between said inner tank outer surface and said sheath inner surface for detecting the presence of liquids within that space.

4. A tank according to claim 3 wherein said liquid detecting means comprises tube means extending from outside said tank to a point adjacent said lower portions of said sheath inner surface, whereby any liquid introduced between the inner tank outer surface and the sheath inner surface may be drawn into that tube.

5. A tank according to claim 1 wherein said inner tank and said sheath are both configured generally as cylinders with closed end portions and wherein said sheath is formed of a cylindrical sidewall portion of predetermined axial length and a pair of separately formed, generally concave end portions each dimensioned to extend over a respective end of said inner tank and each sealingly joined to a respective axial extremity of said sheath cylindrical sidewall portion.

6. A tank according to claim 5 wherein said end portions include on at least a portion of the concave surface thereof a plurality of projections extending outwardly from said concave surface to engage the outer surface of a respective said inner tank end portion.

* * * * *